US006126555A

United States Patent [19]

Schooler

[11] Patent Number: 6,126,555

[45] Date of Patent: Oct. 3, 2000

[54] ADJUSTABLE GOLF PUTTER

[76] Inventor: Paul T. Schooler, 16285 Erin, Fraser, Mich. 48026

[21] Appl. No.: 09/166,131

[22] Filed: Oct. 5, 1998

[51] Int. Cl.[7] ..... A63B 69/36

[52] U.S. Cl. ..... 473/248; 473/251; 473/313; 473/314; 473/340

[58] Field of Search ..... 473/244, 245, 473/246, 247, 248, 313, 340, 341, 251, 314

[56] References Cited

U.S. PATENT DOCUMENTS

| | | | |
|---|---|---|---|
| 749,174 | 1/1904 | Davis . | |
| 1,352,020 | 9/1920 | Olson . | |
| 1,515,998 | 11/1924 | Clark . | |
| 1,643,250 | 9/1927 | Longsworth . | |
| 3,214,170 | 10/1965 | Warnock . | |
| 3,610,630 | 10/1971 | Glover . | |
| 3,909,005 | 9/1975 | Piszel . | |
| 4,073,492 | 2/1978 | Taylor . | |
| 4,111,426 | 9/1978 | Goodwin . | |
| 4,133,535 | 1/1979 | Marsh . | |
| 4,881,737 | 11/1989 | Mullins . | |
| 5,292,123 | 3/1994 | Schimdt | 473/248 |
| 5,348,295 | 9/1994 | Phillips . | |
| 5,388,827 | 2/1995 | Reynolds, Jr. . | |
| 5,390,920 | 2/1995 | Nickum . | |
| 5,415,399 | 5/1995 | Kettelson . | |
| 5,429,356 | 7/1995 | Dingle et al. . | |
| 5,470,063 | 11/1995 | Fisher . | |
| 5,580,051 | 12/1996 | Fisher . | |
| 5,603,666 | 2/1997 | Bowe . | |
| 5,692,969 | 12/1997 | Schooler . | |
| 5,749,790 | 5/1998 | Van Alen | 473/245 |

FOREIGN PATENT DOCUMENTS 9169 1/1909 United Kingdom .

*Primary Examiner*—Jeanette Chapman
*Assistant Examiner*—Stephen L. Blau
*Attorney, Agent, or Firm*—Howard & Howard

[57] ABSTRACT

An adjustable golf putter includes a shaft having a lower end, a pivotal pin attached to the lower end, and a head pivotally retaining the pivot pin. The pivotal pin is pivotally disposed through a slot which is formed through an upper surface of the head and extends downwardly to a longitudinal duct. A supporting member and notches of an abutment are disposed in the duct of the head and only allow movement along the longitudinal axis of the head by abutting against the pivotal pin. A pair of locking members are disposed through the head and abut against the shaft locking the shaft in a selected angular position. The pivotal pin extending in a first direction inserts through the slot and is disposed in the duct. The pivotal pin pivotally lodges within the notches by rotating the pivotal pin roughly 90 degrees from the first direction to a second direction. The support member is then inserted preventing vertical movement of the pivotal pin. Locking members lock the shaft in the selected angular position. The range of movement of the shaft relative to the head is restricted to a single plane movement. Movement along the longitudinal axis of the head is restricted to roughly 30 degrees to 90 degrees relative to the head. Locking members are inserted through the head to selectively lock and unlock the pivotal pin within the head, thereby selectively permitting adjustment of the golf club shaft-head angle.

11 Claims, 2 Drawing Sheets

ADJUSTABLE GOLF PUTTER

BACKGROUND OF THE INVENTION

The invention relates to a golf putter wherein the angle of the head relative to the shaft is adjustable. Golfers of different styles may prefer that the golf club head be mounted on the shaft of the golf club at different angles. Further, a single golfer may wish to vary the golf club head angle for a particular shot or terrain. This is particularly true for putters.

Several known golf clubs have attempted to provide a golf club wherein the angle of the head is adjustable relative to the shaft. One known golf club utilizes a shaft having a lower end terminating in a generally spherical pivot ball. The ball is disposed within a bore in the golf club head and is secured by a locking screw threaded into a bore. This putter has proven successful, but is somewhat difficult to assemble.

A known golf club having an adjustable head includes a shaft having a hub at a lower end. A threaded bolt extends horizontally from the side of the head opposite the face. The bolt is inserted through the hub on the lower end of the shaft. A nut is threaded onto the bolt to secure the shaft to the head in the desired position. Because the shaft is secured to the side of the head, that side cannot be used to contact the golf ball.

Another adjustable golf putter includes an elongated shaft terminating at an adjustable gear linkage which attaches with a corresponding adjustable gear linkage affixed to a stem connected to a putter head. The putter provides adjustment in a plane which is parallel to the hitting face of the putter head. Again, only one side of the head can be used to contact the golf ball.

Generally, the above described prior golf clubs are complex and include many working parts. Moreover, most of these clubs have pivoting structure that enters into the top of the club head and are difficult to assemble.

SUMMARY OF THE INVENTION

The present invention provides an adjustable golf putter having a head, the angle of which is adjustable relative to the shaft. The putter prevents the pivotal movement of the shaft about the axis of the head, i.e. the movement of the head relative to the shaft is restricted generally to a single plane which contains both the shaft and the axis of the head.

The putter includes a shaft having a lower end pivotally secured to an upper surface of a head. The head is preferably generally cylindrical, having longitudinal first and second ends, a flattened lower surface, and convex faces. The convex faces aid the golfer in making proper contact with the golf ball. The head includes a slot which is formed along the upper surface of the head and extends downwardly to a longitudinal duct. The duct is defined by a circumferential wall extending through the head from the first end to the second end.

The putter further includes a pivotal pin having a link stem extending from a preferably cylindrical pivot stem. The pivotal pin, while in a first direction, is inserted through the slot to the duct and is rotated roughly 90 degrees to extend in a second direction. The pivotal pin is retained in the duct while in the second direction. The link stem extends upwardly through the slot from the pivot stem, and attaches at the lower end of the shaft. The pivotal pin is mounted to pivot and allow the shaft to pivotally move along the longitudinal axis of the head.

An abutment is inserted into the duct below the slot to aid in retaining the pivotal pin. The abutment is generally cylindrical with a cut section having an inner surface and an outer surface. A perforation extends through the cut section, and is aligned with the slot to allow the pivotal pin to be inserted into the duct. A pair of opposed notches are formed on the inner surface of the cut section to receive the pivotal pin when it extends in the second direction. A support member is disposed below the pivotal pin to provide support. Locking members are inserted through passages which extend through the ends of the head. The pivotal pin allows pivotal adjustment of the shaft. The locking members lock the shaft in the desired angular position relative to the head after adjustment.

The motion of the shaft is restricted to movement along the longitudinal axis of the head. Movement of the shaft is restricted when the pivotal pin is pivotally lodged within the notches of the abutment and is supported by the support member. This restricts the pivotal pin to pivotal movement only about the axis of the pivotal pin which, in turn, restricts the movement of the shaft along the longitudinal axis of the head. In use, such restriction of movement along only a single axis provides a tight fit to simulate a standard non-adjustable putter and avoids any unwanted tilt of the head. The pivotal movement of the shaft is also restricted to between about 30 degrees and 90 degrees relative to the head.

BRIEF DESCRIPTION OF THE DRAWINGS

The above, as well as other advantages of the present invention, will become readily apparent to those skilled in the art from the following detailed description when considered in the light of the accompanying views of the drawing in which.

DESCRIPTION OF THE PREFERRED EMBODIMENT

Figure 1:
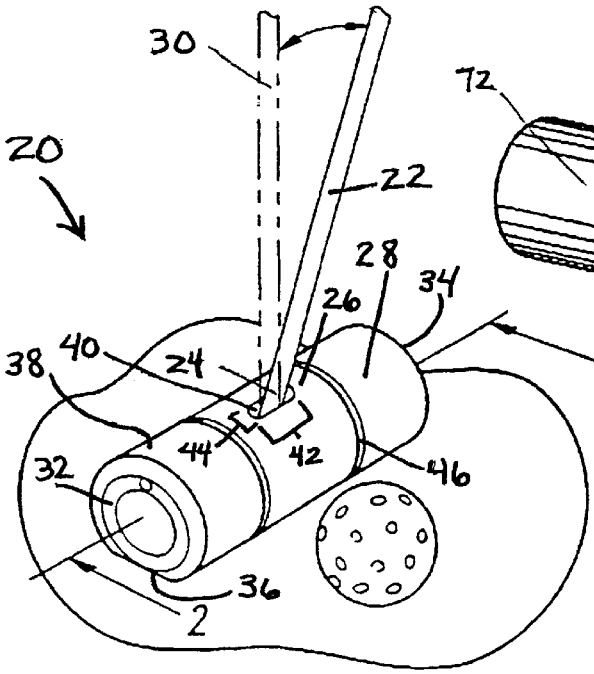
FIG. 1 is a perspective view of the adjustable golf putter according to the present invention.

An adjustable golf putter 20 according to the present invention is shown in FIG. 1. The adjustable putter 20 includes a shaft 22 having a lower end 24 pivotally secured through an upper surface 26 of a head 28. The angle of the shaft 22 relative to the head 28 is selectively adjustable, generally up to a perpendicular position 30 (shown in phantom) perpendicular to the axis 2 of the head 28.

The head 28 is preferably generally cylindrical having longitudinal first and second ends 32, 34, a lower surface 36, and convex faces 38. The head 28 includes a slot 40 which is generally formed along the upper surface 26 of the head 28 and has a first dimension 42 and a second dimension 44. Preferably, the upper surface 26 of the head 28 is curved. The lower surface 36 of the head 28 is preferably flattened.

The putter 20 preferably includes a pair of guidelines 46 about the circumference of the head 28 generally representing one-third markers of the longitudinal length of the head 28. The guidelines 46 assist the golfer in properly hitting the golf ball at the center of gravity of the head 28. The head 28 is preferably made of metal such as aluminum or other suitable material.

Figure 2B:
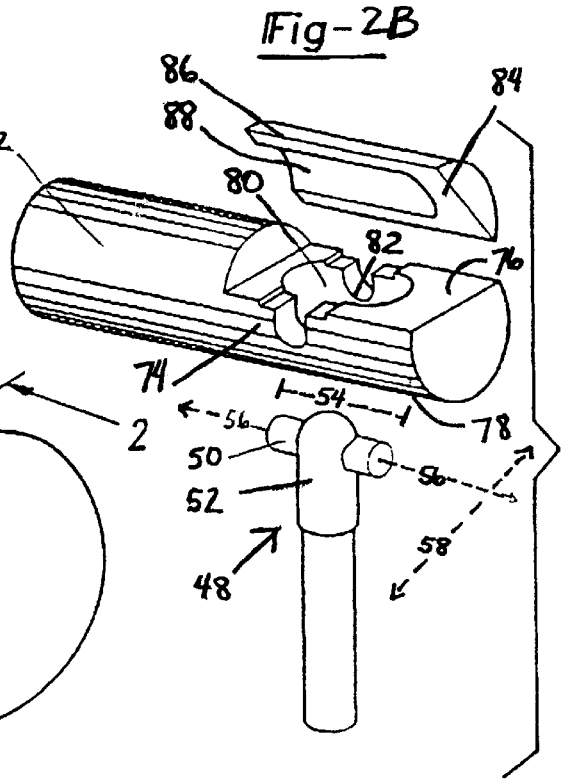
FIG. 2B is a perspective view of an abutment of the putter of FIG. 1.
Figure 2A:
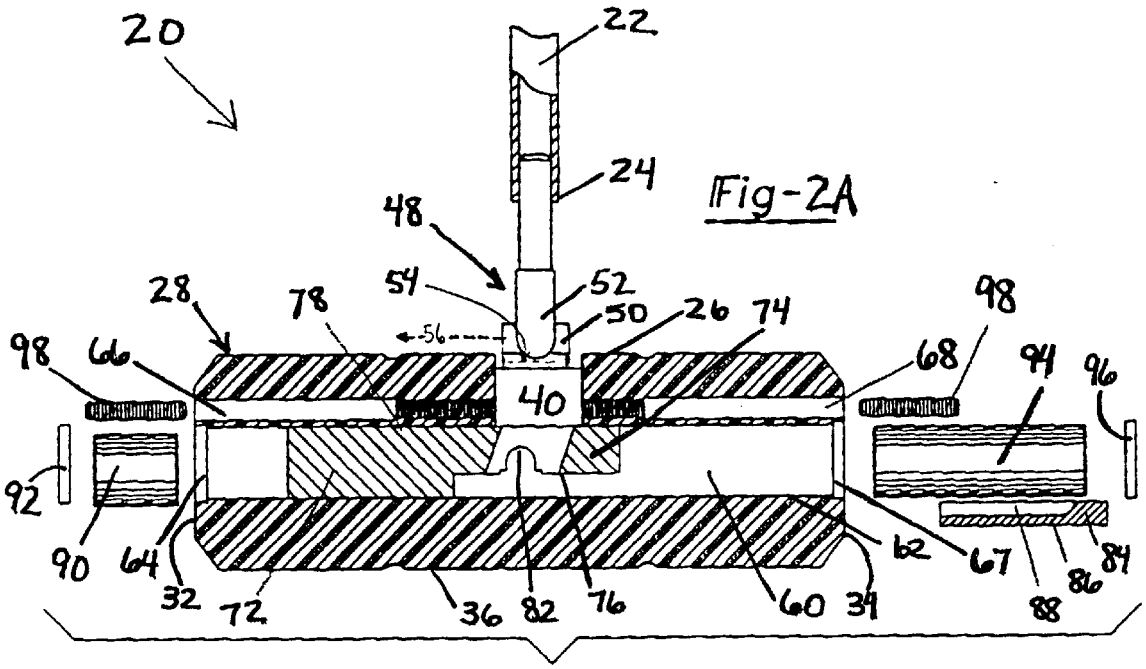
FIG. 2A is an exploded cross-section view of the putter of FIG. 1.

As can be seen in FIG. 2A, the putter 20 further includes a pivotal pin 48 generally comprising a pivot stem 50 extending from a link stem 52. The pivotal pin 48 is retained in the head 28. The pivot stem 50 extends laterally from the link stem 52 between two ends spaced by a distance 54. The pivot stem 50 is preferably cylindrical, but may take other shapes. The link stem 52 attaches at the lower end 24 of the shaft 22 by any suitable means. It should be understood that pivot stem 50 could be attached directly to shaft 22. In either case, the pivot stem 50 is fixed to move with the shaft 22.

As shown in FIG. 2B, the pivotal pin 48 may extend in a first direction 56 and a second direction 58. As seen in FIG. 2A, the pivotal pin 48, while in the first direction 56, inserts through the slot 40. Pivot stem 50 inserts through the slot 40, where the first dimension 42 of the slot 40 is greater than the distance 54 of the pivot stem 50. The second direction 58 of the pivotal pin 48 is defined by rotating the pivotal pin 48 roughly 90 degrees from the first direction 56 along the axis of the shaft 22. The second dimension 44 of the slot 40 is less than the distance 54 of the pivot stem 50. The slot 40 extends downwardly through the upper surface 26 to a longitudinal duct 60 which is defined by a circumferential wall 62 extending through the head 28 from the first end 32 to the second end 34.

The first end 32 includes a first opening 64 of the duct 60 and a first passage 66 formed above the duct 60. The first passage 66 extends inwardly and intersects with the slot 40. The first passage 66 is preferably threaded. The duct 60 extends through the head 28 to the second end 34, defining a second opening 67. The second end 34 includes the second opening 67 of the duct 60 and a second passage 68 formed above the duct 60. The second passage 68 extends inwardly and intersects with the slot 40. The second passage 68 is preferably threaded.

An abutment 72 inserts through the duct 60 and is disposed below the slot 40 to aid in retaining the pivotal pin 48. Preferably, as can be seen in FIG. 2B, the abutment 72 is generally cylindrical with a cut section 74 having an inner surface 76 which faces downwardly and a curved outer surface 78 which is disposed against the wall 62 of the duct 60. A perforation 80 extends through the cut section 74 and is roughly equal to the dimensions of the slot 40. The cut section 74 aligns with the slot 40 to allow the pivotal pin 48 to insert into the duct 60. A pair of opposed notches 82 which face downwardly are formed on the inner surface 76 and extend laterally from the perforation 80.

As can be seen in FIG. 2A, a support member 84 having a base 86 and a concave receptor 88 inserts through the second opening 67. The support member 84 is disposed against the inner surface 76 of the cut section 74 such that the base 86 abuts wall 62 of the duct 60 and the receptor 88 encloses the inner surface 76. The support member 84 aligns with the abutment 72, and in combination provides a cylindrical member disposed within the duct 60.

A first filler 90 inserts through the first opening 64 and is disposed against the abutment 72 for support. Preferably, a first cover 92 is disposed against the first filler 90 to provide a flush surface at the first end 32. A second filler 94 inserts through the second opening 67 and is disposed against both the abutment 72 and the support member 84 to provide support. Preferably, a second cover 96 is disposed against the second filler 94 to provide a flush surface at the second end 34.

Locking members 98 insert through passages 66, 68. Locking members 98 are elongated and preferably threaded. Locking members 98 preferably are threaded into passages 66, 68 to abut with the shaft 22 and lock the shaft 22 at the desired angular position.

Figure 3:
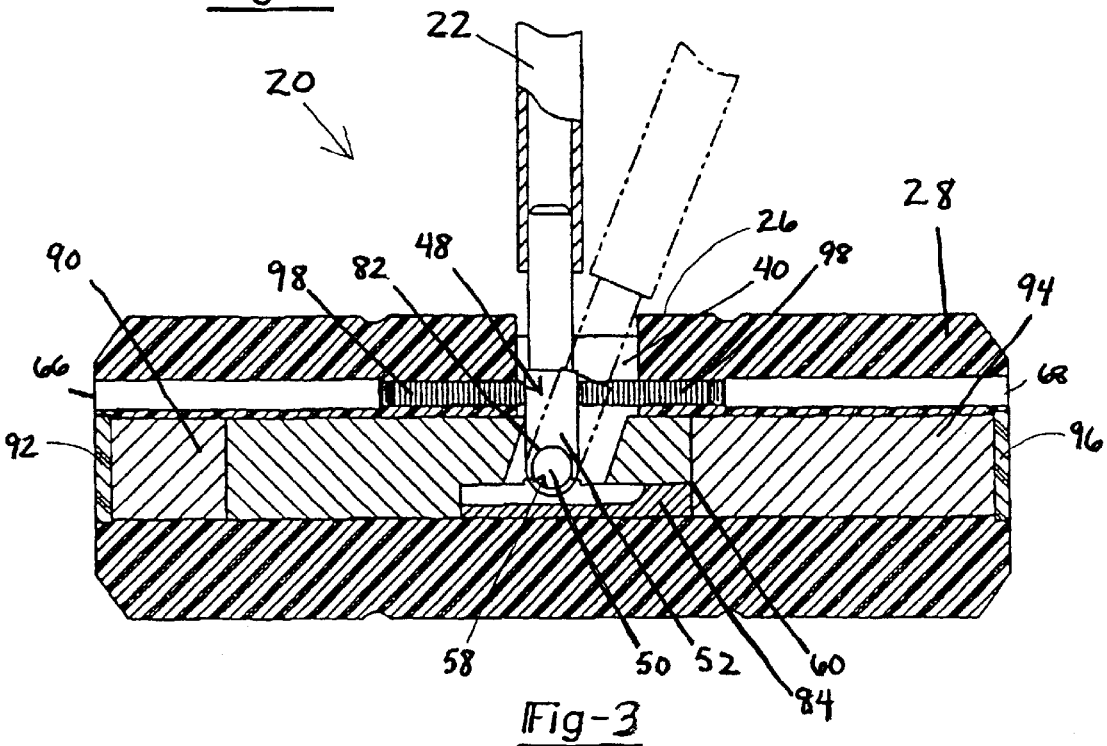
FIG. 3 is a side view of part of the putter of FIG. 1.

As can be seen in FIG. 3, the pivot stem 50 of the pivotal pin 48 is pivotally disposed within the duct 60. The link stem 52 of the pivotal pin 48 extends through the slot 40 and protrudes above the upper surface 26 of the head 28, where it is inserted into the shaft 22. The pivotal pin 48, extending in the second direction 58, is lodged within the notches 82 by the support of the support member 84 and locked in angular position by locking members 98. The angle of the shaft 22 is selectively adjustable when locking members 98 are loosened from the shaft 22. The angle of the shaft 22 may be adjusted between about 30 degrees (shown in phantom in FIG. 3) and 90 degrees relative to the head 28. This range is provided by aligning notches 82 closer to one end of slot 40, then the other. The first filler 90 and second filler 94 provide further support and lessen shifting of the abutment 72. The first cover 92 and second cover 96 further lessen shifting.

Figure 4:
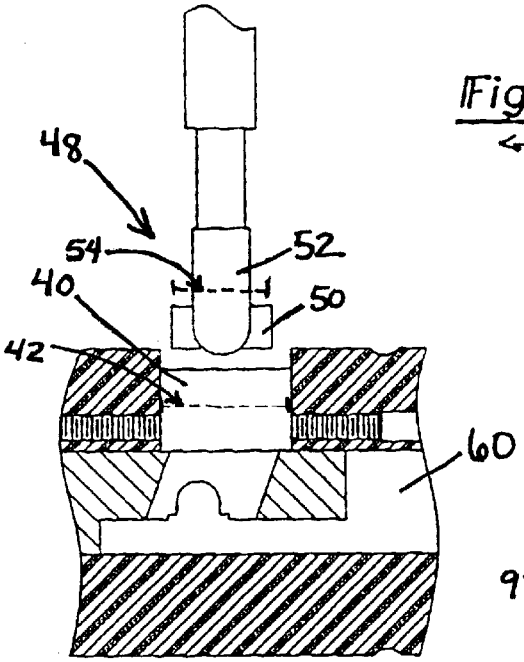
FIG. 4 is a side view of the pivotal pin and part of the head of the putter of FIG. 1.

As can be seen in FIG. 4, the distance 54 of the pivot stem 50 is less than the first dimension 42 of the slot 40. This allows the pivotal pin 48 to insert through the slot 40 into the duct 60.

Figure 5:
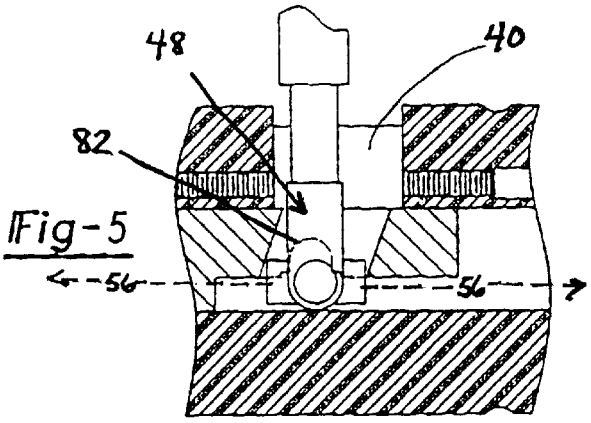
FIG. 5 is a side view of the pivotal pin extending in the first direction in the head of FIG. 4.

As can be seen in FIG. 5, the pivotal pin 48 is inserted through the slot 40 extending in the first direction 56.

Figure 6:
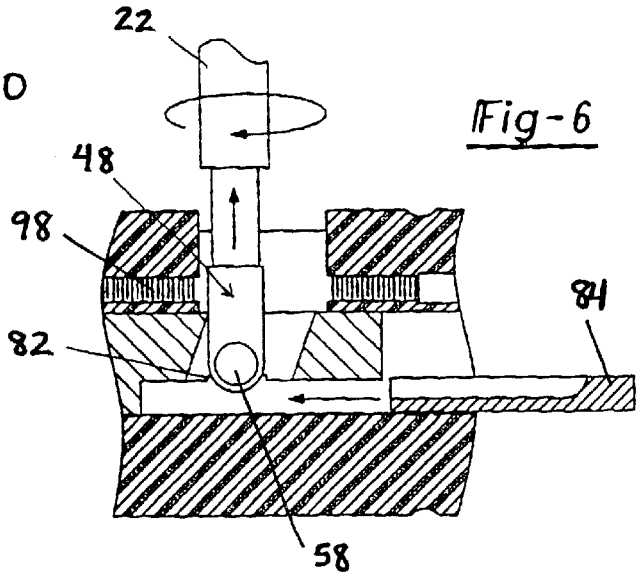
FIG. 6 is a side view of the pivotal pin extending in a second direction in the head of FIG. 5.

As can be seen in FIG. 6, the pivotal pin 48 pivotally lodges within the notches 82 by rotating the pivotal pin 48 to the second direction 58 and pulling upwardly. The support member 84 is then inserted to add support by being disposed below the pivotal pin 48 and preventing vertical movement for the pivotal pin 48. Locking members 98 locks the shaft 22 in the selected angular position.

In use, the shaft 22 is restricted to movement only in a single plane. Such movement restriction of the shaft 22 is limited to motion along the longitudinal axis 2 of the head 28. Movement of the shaft 22 is restricted when the pivotal pin 48 is lodged within the notches 82 of the abutment 72 and is supported by the support member 84. This restricts the pivotal pin 48 to pivotal movement only about the axis of the pivotal pin 48 which, in turn, restricts the movement of the shaft 22 along the longitudinal axis 2 of the head 28. Such restriction of movement provides a tight fit simulating a conventional non-adjustable putter and avoids any unwanted tilt of the head 22. The pivotal movement of the shaft 22 is also restricted to between about 30 degrees and 90 degrees relative to the head 28.

In accordance with the provision of the patent statutes, the present invention has been described in what is considered to represent a detailed description of the invention. However, it should be noted that the invention can be practiced in any other manner than as specifically illustrated and described without departing from its spirit or scope.

What is claimed is:

1. A golf club comprising:

a. a shaft having a lower end;

b. a pivotal pin attached at said lower end of said shaft, said pivotal pin extending between two ends spaced by a distance;

c. an elongated head having an upper surface, said upper surface including a slot formed therethrough and terminating at a duct, said slot having a first dimension greater than said distance of said pivotal pin, said slot having a second dimension less than said distance of said pivotal pin, said head retaining said pivotal pin;

d. notches formed in said duct to receive said pivotal pin;

e. a support member disposed in said duct, said support member engaging with said pivotal pin;

f. at least one elongated locking member disposed in aid head; and g. said head further having a first end and a second end, said first end having a first passage and a first opening of said duct, said first passage being formed through said first end above said duct and extending inwardly from said first end to intersect with said slot, said first opening being formed through said first end and extending through said head to the second end defining a second opening of said duct, said second end having a second passage in said second opening, said second passage formed through said second end above said duct and extending inwardly from said second end to intersect with said duct.

2. A golf club as in claim 1, wherein said pivotal pin includes a link stem and a pivot stem, said link stem attached to said lower end of said shaft, said pivot stem connecting to said link stem and extending from said link stem by said distance.

3. A golf club as in claim 1, wherein said at least one locking member includes a first locking member and a second locking member, said first locking member disposed through said first passage, said second locking member disposed through said second passage, said locking members abutting against said pivotal pin angularly locking said shaft relative to said head.

4. A golf club as in claim 3, wherein said locking members are disposed at opposed ends of said shaft.

5. A golf club as recited in claim 1, wherein said notches are formed in an abutment member, said abutment member including a cut section having an inner surface, and a perforation extending therethrough and communicating to said slot, with notches being formed in said inner surface.

6. A golf club as in claim 5, wherein said support member is disposed in said duct below said notches and abuts with said abutment, said support member engaging with inner surface of abutment and supporting said pivotal pin.

7. A golf club as in claim 1, wherein said notches and said support member restrict the pivotal movement of said shaft relative to said head generally to a plane containing the axis of said shaft and the axis of said head.

8. A golf club as recited in claim 1, wherein said notches are spaced closer to one end of said slot then an opposed end of said slot in said first dimension to provide restriction of movement of said shaft relative to said head.

9. A method of adjusting a golf club comprising the steps of:

a. providing a club including a pivotal pin attached to a shaft and a head retaining said pivotal pin, said head having a slot formed through said head and extending to a duct, said pivotal pin extending between two ends spaced by a distance, said slot having a first dimension greater than said distance and a second dimension less than said distance in a second direction;

b. inserting said pivotal pin in said first direction through said slot and into said duct;

c. turning said pivot pin substantially 90 degrees from said first direction along the axis of said shaft to said second direction; and d. locking said shaft relative to said head.

10. A method as in claim 9, further including the step of restricting movement of said shaft to pivotal movement along a plane containing said shaft and the axis of said head.

11. A golf club comprising:

a. a shaft having a lower end;

b. a pivotal pin attached at said lower end of said shaft, said pivotal pin extending between two ends spaced by a distance;

c. an elongated head having an upper surface, said upper surface including a slot formed therethrough and terminating at a duct, said slot having a first dimension greater than said distance of said pivotal pin, said slot having a second dimension less than said distance of said pivotal pin, said head retaining said pivotal pin;

d. notches formed in said duct to receive said pivotal pin;

e. a support member disposed in said duct, said support member engaging with said pivotal pin;

f. at least one elongated locking member disposed in said head; and g. said notches and said support member restricting pivotal movement of said shaft relative to said head generally to a plane containing the axis of said shaft and the axis of said head.

* * * * *